US008757277B2

(12) United States Patent
Dekker et al.

(10) Patent No.: US 8,757,277 B2
(45) Date of Patent: Jun. 24, 2014

(54) TORQUE REACTION DEVICE FOR PIPE RUNNING TOOL

(75) Inventors: Pieter Dekker, Baarland (NL); Richard Lee Murray, Jr., Foothill Ranch, CA (US); Richard Verhoef, Akkrum (NL)

(73) Assignee: National Oilwell Varco, L.P., Houston, TX (US)

( * ) Notice: Subject to any disclaimer, the term of this patent is extended or adjusted under 35 U.S.C. 154(b) by 406 days.

(21) Appl. No.: 13/240,704

(22) Filed: Sep. 22, 2011

(65) Prior Publication Data

US 2013/0075114 A1 Mar. 28, 2013

(51) Int. Cl.
*E21B 19/18* (2006.01)

(52) U.S. Cl.
USPC ..... 166/380; 166/77.51; 166/85.1; 166/77.52

(58) Field of Classification Search
CPC ..... E21B 44/04; E21B 19/166; E21B 44/06
USPC ..... 166/380, 77.52, 77.1, 85.5; 294/102.2; 81/57.24, 57.35
See application file for complete search history.

(56) References Cited

U.S. PATENT DOCUMENTS 4,421,447 A * 12/1983 Gudgel et al. ..... 414/22.68
4,449,596 A * 5/1984 Boyadjieff ..... 175/85
4,479,547 A * 10/1984 Boyadjieff et al. ..... 166/383
4,489,794 A * 12/1984 Boyadjieff ..... 175/85
4,605,077 A * 8/1986 Boyadjieff ..... 175/85
4,625,796 A * 12/1986 Boyadjieff ..... 166/77.52
5,107,940 A * 4/1992 Berry ..... 175/85
6,443,241 B1 * 9/2002 Juhasz et al. ..... 175/52
6,832,658 B2 * 12/2004 Keast ..... 175/170
7,117,938 B2 * 10/2006 Hamilton et al. ..... 166/77.53
7,320,374 B2 * 1/2008 Folk et al. ..... 175/220
7,559,380 B1 * 7/2009 McKnight ..... 175/203
7,673,675 B2 * 3/2010 Carr et al. ..... 166/77.51
8,356,674 B2 * 1/2013 Murray et al. ..... 166/380
8,573,329 B2 * 11/2013 Begnaud et al. ..... 175/85
2003/0132005 A1 * 7/2003 Tulloch et al. ..... 166/380
2010/0193198 A1 8/2010 Murray et al.
2011/0280104 A1 * 11/2011 McClung, III ..... 367/82
2012/0160517 A1 * 6/2012 Bouligny et al. ..... 166/380
2013/0269926 A1 * 10/2013 Liess et al. ..... 166/77.51

* cited by examiner

*Primary Examiner* — Brad Harcourt
*Assistant Examiner* — David Carroll
(74) *Attorney, Agent, or Firm* — Christie, Parker & Hale, LLP

(57) ABSTRACT

The present disclosure relates to the field of drilling equipment for the discovery and production of hydrocarbons from the earth. In particular, this disclosure relates to a torque reaction device for coupling a pipe running tool to a top drive assembly on a drilling rig. In one embodiment, a system for coupling a pipe segment to a pipe string includes a top drive assembly, a pipe running tool, and a torque reaction device. The top drive assembly includes an output shaft and a link extending from the top drive. The top drive is operative to rotate the output shaft with respect to the link. The pipe running tool is coupled to the output shaft and is engageable with a pipe segment to transmit torque from the output shaft to the pipe segment. The torque reaction device couples the pipe running tool to the link.

21 Claims, 7 Drawing Sheets

TORQUE REACTION DEVICE FOR PIPE RUNNING TOOL

FIELD OF THE INVENTION

The present disclosure relates to the field of drilling equipment for the discovery and production of hydrocarbons from the earth. In particular, this disclosure relates to a torque reaction device for coupling a pipe running tool to a top drive assembly on a drilling rig.

BACKGROUND

Systems for drilling wellbores into the earth for the discovery and production of hydrocarbons such as oil and natural gas have been developed in the prior art, as disclosed, for example, in U.S. Pat. No. 6,443,241 and U.S. Publication No. 2010/0193198, the contents of which are incorporated herein by reference. Some drilling systems include a tool for securing pipe segments to a pipe string and lowering the pipe string into the wellbore. These pipe segments may be casing segments which are connected together to line the wellbore. The drilling system rotates these pipe segments and/or the pipe string to connect the pipe segments together and to lower the pipe string into the wellbore.

It may be necessary to secure components of the drilling system against the torque that is applied to rotate the pipe segment and/or pipe string. For example, some components of the drilling system may be coupled to feed lines or systems that are not designed to rotate. Some drilling systems are designed to provide torque reaction with brackets or other structures attached to the drilling rig frame, but these systems are difficult to design and install on each individual drilling rig. Accordingly there remains a need for a compact and effective torque reaction device for a drilling system.

SUMMARY

The present disclosure relates to the field of drilling equipment for the discovery and production of hydrocarbons from the earth. In particular, this disclosure relates to a torque reaction device for coupling a pipe running tool to a top drive assembly on a drilling rig. In one embodiment, a drilling system includes a top drive assembly and a pipe running tool. The top drive assembly includes a pair of downwardly extending rigid links. The top drive assembly rotates an output shaft, and the pipe running tool is coupled to the output shaft. The pipe running tool includes a reacting portion which is rotationally fixed, and a pipe engaging portion which is rotated by the top drive output shaft. The pipe engaging portion is engageable with a pipe segment to transmit rotation to the pipe segment, in order to couple the pipe segment to a pipe string. A torque reaction device is mounted to the reacting portion of the pipe running tool in order to prevent this portion of the pipe running tool from rotating along with the output shaft. The torque reaction device is also coupled to the links extending from the top drive assembly. The torque applied to the upper portion of the pipe running tool by the output shaft is countered by the torque reaction device, which reacts against the links. The links, in turn, pass this torque through the top drive assembly to the guide rails on the drilling derrick. The torque reaction device is a compact structure that can be adjusted to fit various top drive and link geometries in order to effectively maintain the orientation of the upper portion of the pipe running tool against rotation by the top drive output shaft.

In one embodiment, a system for coupling a pipe segment to a pipe string includes a top drive assembly, a pipe running tool, and a torque reaction device. The top drive assembly includes an output shaft and a link extending from the top drive. The top drive is operative to rotate the output shaft with respect to the link. The pipe running tool is coupled to the output shaft and is engageable with a pipe segment to transmit torque from the output shaft to the pipe segment. The torque reaction device couples the pipe running tool to the link.

In one embodiment, a pipe running tool for use with a top drive assembly is provided, for handling pipe segments and for engaging pipe segments to a pipe string. The pipe running tool includes an upper reacting portion and a lower pipe engaging portion engageable with a pipe segment and rotatable with respect to the upper reacting portion, for transmitting torque to the pipe segment. The pipe running tool also includes a torque reaction device mounted to the upper reacting portion and securable to a portion of the top drive assembly, for transmission of torque from the upper reacting portion to such a top drive assembly.

In one embodiment, a method is provided for reacting torque applied to a pipe running tool in a drill rig having a top drive assembly. The method includes providing a pipe running tool having a lower pipe engaging portion, an upper reacting portion, and a torque reaction device mounted to the upper reacting portion. The method also includes coupling the pipe running tool to an output shaft of a top drive assembly, and coupling the torque reaction device to a link extending from the top drive assembly.

DETAILED DESCRIPTION

The present disclosure relates to the field of drilling equipment for the discovery and production of hydrocarbons from the earth. In particular, this disclosure relates to a torque reaction device for coupling a pipe running tool to a top drive assembly on a drilling rig. In one embodiment, a drilling system includes a top drive assembly and a pipe running tool. The top drive assembly includes a pair of downwardly extending rigid links. The top drive assembly rotates an output shaft, and the pipe running tool is coupled to the output shaft. The pipe running tool includes a reacting portion which is rotationally fixed, and a pipe engaging portion which is rotated by the top drive output shaft. The pipe engaging portion is engageable with a pipe segment to transmit rotation to the pipe segment, in order to couple the pipe segment to a pipe string. A torque reaction device is mounted to the reacting portion of the pipe running tool in order to prevent this portion of the pipe running tool from rotating along with the output shaft. The torque reaction device is also coupled to the links extending from the top drive assembly. The torque applied to the upper portion of the pipe running tool by the output shaft is countered by the torque reaction device, which reacts against the links. The links, in turn, pass this torque through the top drive assembly to the guide rails on the drilling derrick. The torque reaction device is a compact structure that can be adjusted to fit various top drive and link geometries in order to effectively maintain the orientation of the upper portion of the pipe running tool against rotation by the top drive output shaft.

Figure 1:
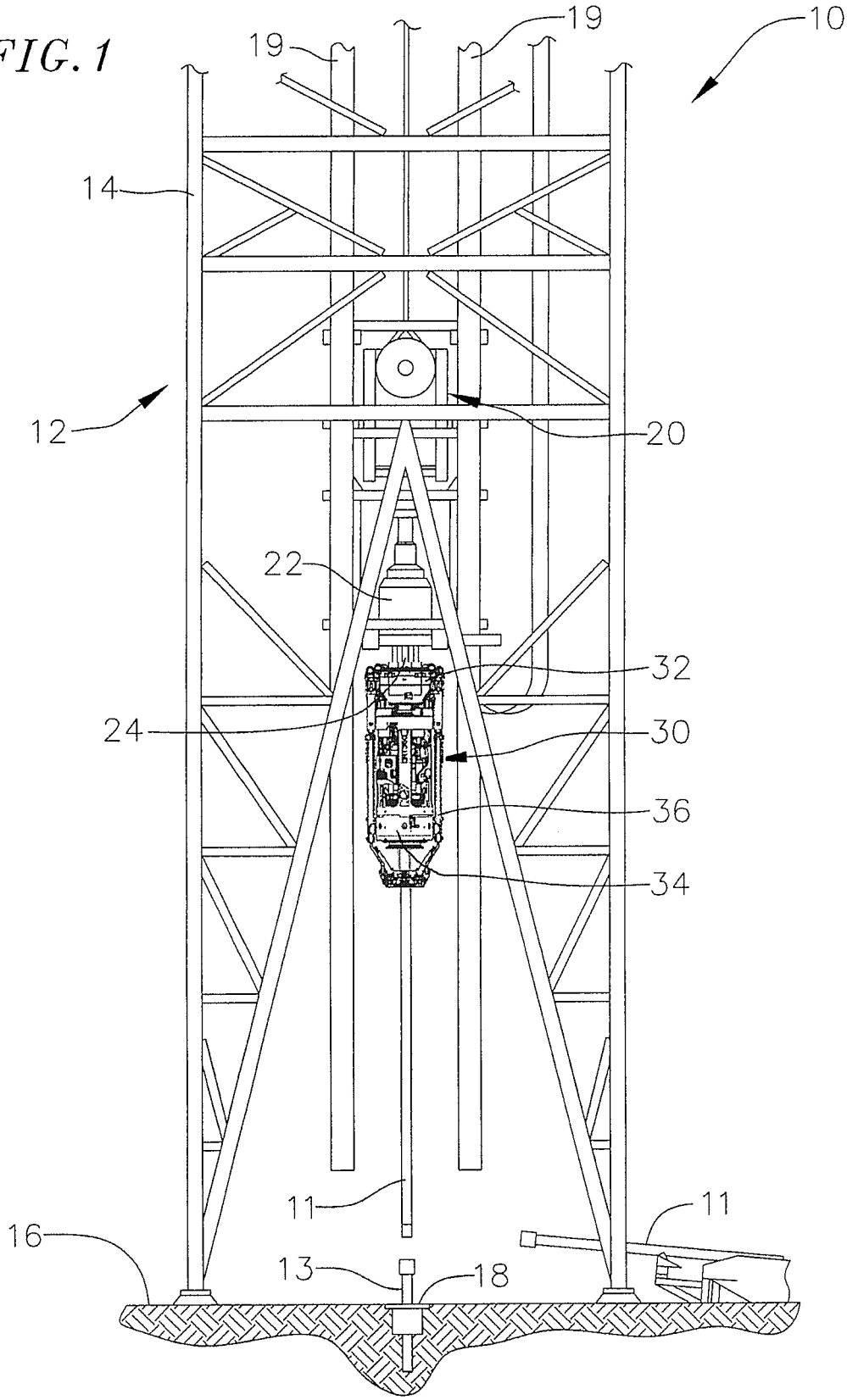
FIG. 1 is a side elevational view of a drilling system according to an embodiment of the invention.

A drilling system 10 according to an embodiment of the invention is shown in FIG. 1. The drilling system includes a rig or derrick 12, a top drive assembly 20 mounted to the derrick, and a pipe running tool 30 coupled to the top drive assembly. The derrick 12 includes a frame 14 that extends above a drill opening 18 in a drill floor 16. The frame 14 includes two vertical guide beams or guide rails 19. The drilling system 10 may be used for minerals exploration and recovery, and in particular the recovery of petroleum or natural gas.

The top drive assembly 20 is mounted to the frame 14, such as to the guide rails 19 that extend vertically along the frame. The top drive assembly 20 includes a motor 22 that is operated to rotate an output shaft 24. The output shaft extends downwardly from the top drive assembly. It should be noted that there are numerous derrick arrangements and rig and equipment configurations possible for use for drilling boreholes into the earth with top drive systems, and the present disclosure is not limited to the particular configurations as detailed herein.

In one embodiment, the pipe running tool 30 is coupled to the output shaft 24 of the top drive assembly 20, for rotation of the pipe running tool by the output shaft. The pipe running tool 30 includes an upper reacting portion 32 and a lower pipe engaging portion 34 and a pair of links 36. The lower pipe engaging portion 34 is engageable with a pipe segment 11 to lift the pipe segment above the drill floor and to rotate the pipe segment 11 to threadedly engage it with a pipe string 13. The lower pipe engaging portion 34 may also be used to grip the pipe segment 11 to lift the entire pipe string 13 to lower it into the wellbore. In one embodiment, the lower pipe engaging portion 34 includes an elevator with slips that are moved radially inwardly to grip the exterior of the pipe segment 11 to vertically support the pipe segment and/or pipe string and to transmit rotation to the pipe segment and/or pipe string. In one embodiment, the lower pipe engaging portion 34 includes an internal gripper with slips that are moved radially outwardly to grip the interior of the pipe segment 11 to vertically support the pipe segment and/or pipe string and to transmit rotation to the pipe segment and/or pipe string.

In operation, the pipe running tool 30 grips a pipe segment 11 and suspends it above the pipe string 13 in the wellbore. The pipe running tool 30 lowers the pipe segment 11 until it reaches the pipe string 13, and then the top drive assembly 20 is operated to rotate the output shaft 24, which rotates the lower pipe engaging portion 34, in order to thread the pipe segment 11 to the pipe string 13. Once the pipe segment 11 is threaded to the string, the pipe running tool 30 lifts the pipe string out of the spider on the drill floor, and lowers the pipe string into the wellbore until the top of the newly added pipe segment 11 is just above the drill floor. The floor spider is then reengaged, and the pipe running tool releases the pipe string and is raised to accept a new pipe segment so that the process can be repeated. This process is used to lower pipe such as casing pipe into the wellbore and may be referred to as "running" pipe into the wellbore.

Figure 2:
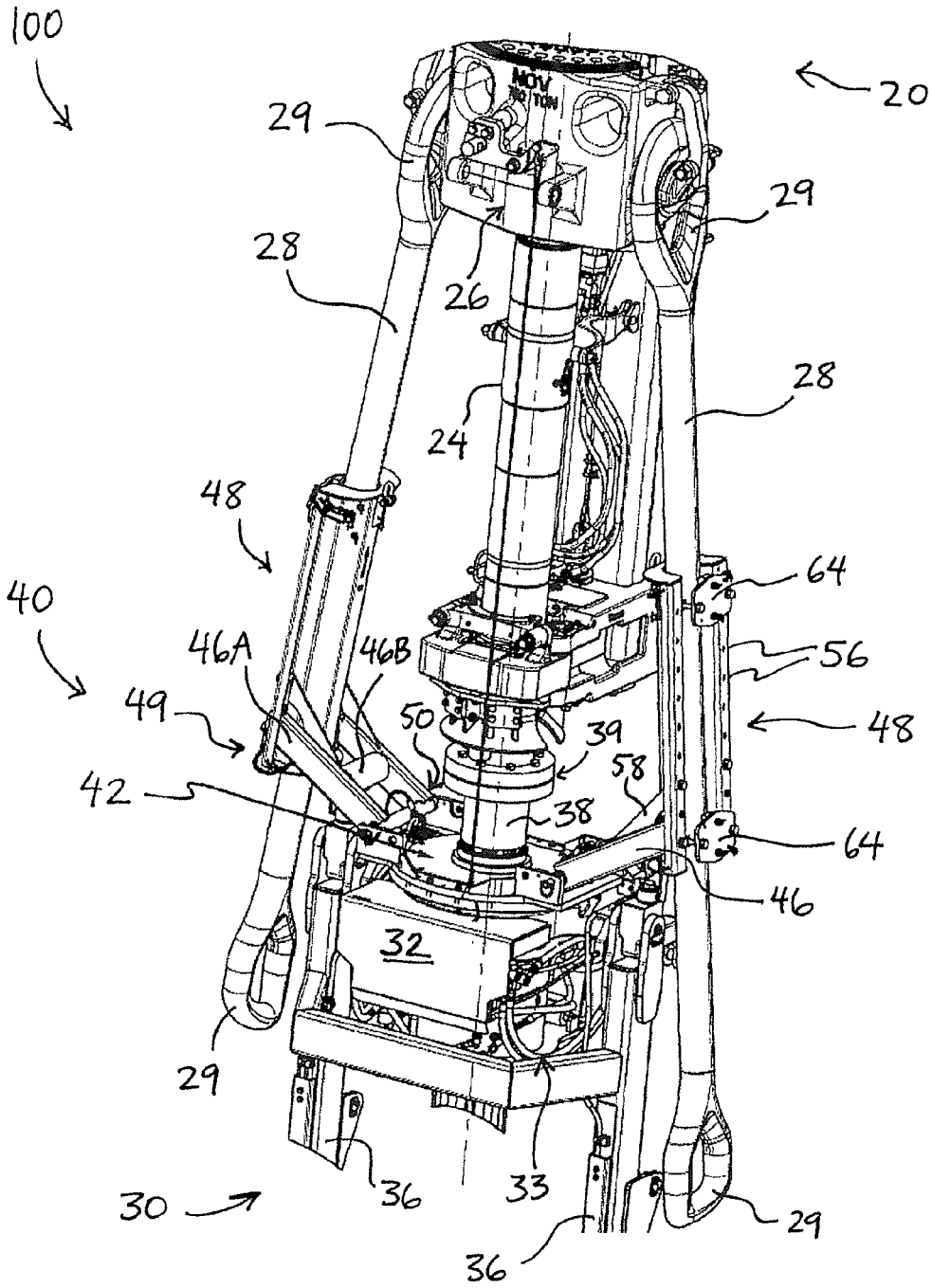
FIG. 2 is a side perspective view of a portion of a drilling system according to an embodiment of the invention.

In one embodiment, the top drive assembly 20 is also used during drilling operations, to rotate a drill string to drill the wellbore. During drilling operations, the pipe running tool 30 is disconnected from the top drive assembly and is not used. During drilling, a pair of links 28 (shown in FIG. 2) extending downwardly from the top drive assembly may be used to hoist the drill string, such as by connecting the links 28 to a drill string elevator. The links 28 assist in supporting the weight of the drill string to lift it or lower it into the wellbore. During this hoisting operation, the links 28 do not rotate. As shown in FIG. 2, the links 28 may be attached at their upper ends to a top drive elevator 26. To prevent the elevator 26 from rotating when the links 28 are being used, the top drive elevator 26 may include an internal rotational lock or may be attached to other external locking components (such as cables, chains, or other couplings) to prevent it from rotating. The links 28 may also be used with a casing elevator during casing running operations, if a pipe running tool is not utilized.

According to an embodiment of the invention, the drilling system 10 includes a torque reaction device for rotationally fixing the upper portion 32 of the pipe running tool with respect to the output shaft 24 of the top drive assembly 20. A torque reaction device according to exemplary embodiments of the invention is shown in various views in FIGS. 2-8.

Figure 3:
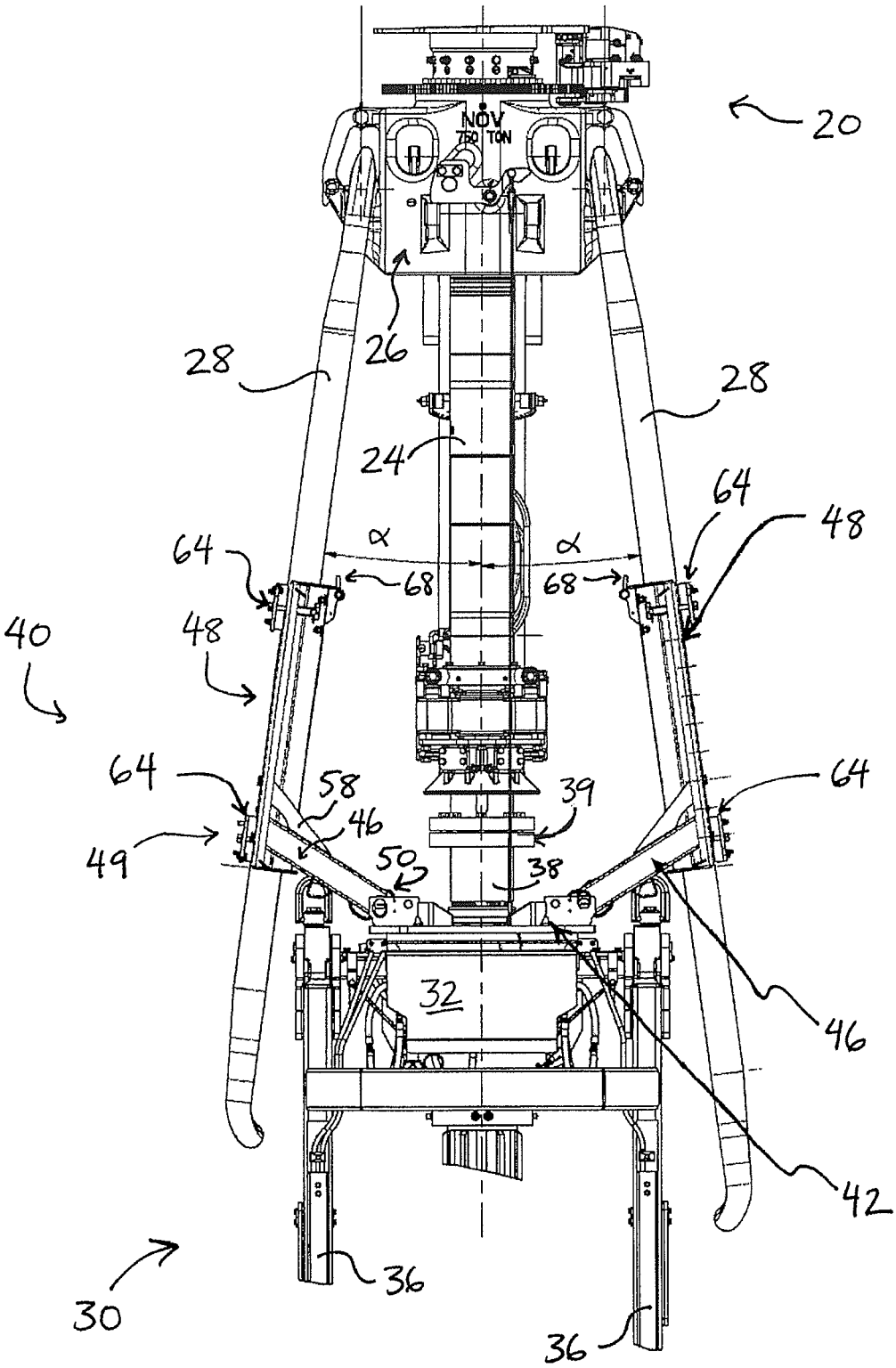
FIG. 3 is a front view of the system of FIG. 2.
Figure 4:
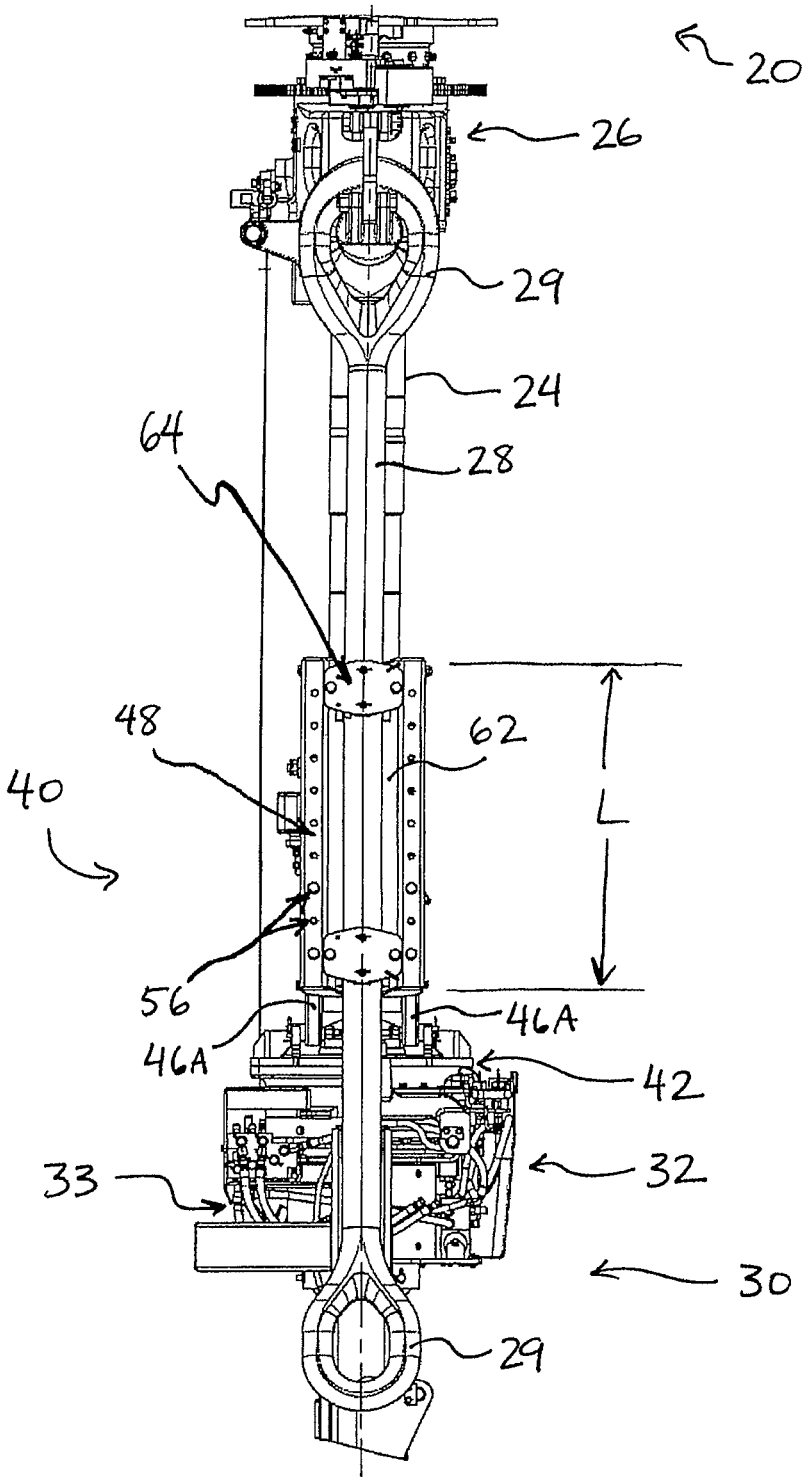
FIG. 4 is a side view of the system of FIG. 2.

FIG. 2 shows a partial view of a drilling system 100, including the lower end of a top drive assembly 20, and the upper end of a pipe running tool 30. In the embodiment shown, the top drive assembly 20 includes an elevator 26, which is situated below the top drive motor (not shown in FIG. 2). The output shaft 24 of the top drive extends downwardly from the elevator 26. A pair of links 28 also extends downwardly from the elevator 26, on opposite sides of the shaft 24. As mentioned above, these links 28 may be provided on drilling systems for hoisting a drill string during drilling operations, but the links 28 are not needed during pipe running operations when a pipe running tool is provided. The links 28 include loops or ears 29 at each end of each link, for attachment at the top end of the links to the top drive assembly 20, such as to the elevator 26, and for attachment at the bottom end of the links to another component such as a drill string elevator, if needed (not shown). In FIG. 2, the upper ends of the links 28 are connected to the elevator 26 and the lower ends of the links 28 are left free. During use of the pipe running tool 30, the elevator 26 is locked against rotation. Two links 28 of different lengths are shown in FIG. 3, for reference, to show the different types of links that may be used on different drilling installations—although for a single installation, both links are the same length. As an example, the links shown may be 11-12 feet in length.

The pipe running tool 30 includes an upper reacting portion 32, a lower pipe engaging portion (not shown in FIG. 2, see portion 34 of FIG. 1), and a shaft portion 38 extending up from the upper reaction portion. Optionally, the pipe running tool 30 may also include a pair of links 36 extending downward from the upper reacting portion to below the lower pipe engaging portion. In the embodiment shown in FIG. 2, the pipe running tool 30 is coupled directly to the output shaft 24 of the top drive by threading the shaft 38 of the pipe running tool to the output shaft 24 of the top drive assembly. These two components can be threaded together and secured by a clamp 39. The shaft 38 of the pipe running tool passes through the upper reacting portion 32 and is rotationally coupled to the lower pipe engaging portion (not shown in FIG. 2) such that rotation of the shaft 38 causes a corresponding rotation of the lower pipe engaging portion.

In one embodiment, the upper reacting portion 32 of the pipe running tool 30 is a housing assembly or fixture that is coupled to one or more power supply lines 33, such as hydraulic hoses or electrical power lines, or other control or feedback lines and cables, in order to provide power and/or control signals to or from the pipe running tool. In some systems, these power lines are not designed to rotate. The upper reaction portion 32 includes a passage for the shaft 38 and a bearing (not shown) that allows rotation of the shaft 38 with respect to the upper reacting portion 32 so that the upper reacting portion 32 can be rotationally fixed while the shaft 38 and the lower pipe engaging portion rotate. The upper reacting portion 32 also attaches to the links 36. In one embodiment, the upper reacting portion 32 is a link tilt assembly, which includes a drive mechanism to rotate the links 36.

The drilling system 100 also includes a torque reaction device 40 coupled between the pipe running tool 30 and the top drive assembly 20. The torque reaction device 40 may be coupled to any non-rotating portion of the top drive assembly, such as a rigid housing or fixture extending downwardly toward the pipe running tool. In one embodiment, the torque reaction device 40 is coupled between the upper reacting portion 32 of the pipe running tool 30 and the links 28 of the top drive assembly 20. The links 28 that extend downwardly from the top drive assembly 20 do not rotate with the top drive output shaft 24. The torque reaction device 40 couples the upper reacting portion 32 to the links 28 so that the upper reacting portion 32 can be held rotationally fixed while the output shaft 24 and the pipe running tool shaft 38 rotate. The torque reaction device 40 reacts against the links 28 to counter the torque applied by the shafts 24, 38 to the upper reacting portion 32. Although the upper reacting portion 32 includes a passage and a bearing for the shaft 38, these components are not able to completely isolate the upper reacting portion 32 from the shaft 38, and some torque will be transferred, including through friction within the bearing and between various components.

The torque reaction device 40 fixes the rotational orientation of the upper reacting portion 32 by providing a rigid connection between the upper reacting portion 32 and the non-rotating links 28. The links 28 in turn react against the non-rotating components of the top drive assembly 20, such as the elevator 26, and the top drive assembly in turn reacts against the guide rails 19 of the derrick 12 (see FIG. 1). Through these connections, the upper reacting portion 32 can be fixed in rotation orientation while the shafts 24, 38 spin.

Various details of the torque reaction device 40 according to embodiments of the invention will be described with reference to FIGS. 2-8. In one embodiment, the torque reaction device 40 includes a base plate 42 mounted to the upper reacting portion 32. The base plate 42 is formed as a ring 42A with an opening 42B for passage of the shaft 38. The base plate 42 is mounted to the upper reacting portion 32 by several bolts 42C (FIG. 5) or other suitable mechanical connectors. In another embodiment, the base plate 42 can be integrally formed into the top of the upper reacting portion.

The base plate 42 is coupled to the top drive links 28 by a pair of reaction arm assemblies 44, one on each side of the base plate 42. Each reaction arm assembly 44 includes a reaction arm 46 and a clamp 48. The reaction arm 46 extends outwardly from the base plate 42 toward the corresponding link 28. In one embodiment, each reaction arm 46 includes two reaction arm members 46A connected by a cross-member 46B. The reaction arm 46 is rigidly attached to the corresponding clamp 48 at an elbow 49. In one embodiment, the base plate 42, reaction arms 46, and clamps 48 are made from steel.

Figure 5:
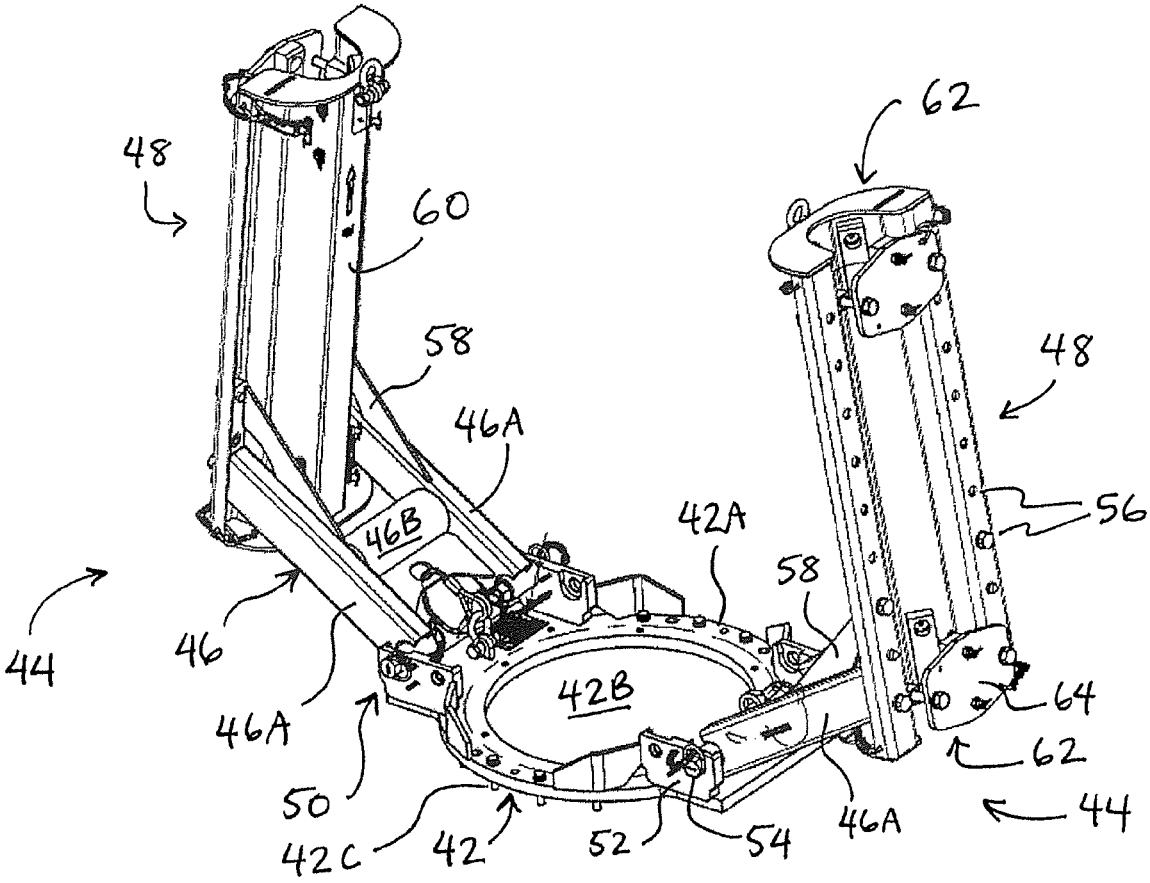
FIG. 5 is a perspective view of a torque reaction device according to an embodiment of the invention.
Figure 8:
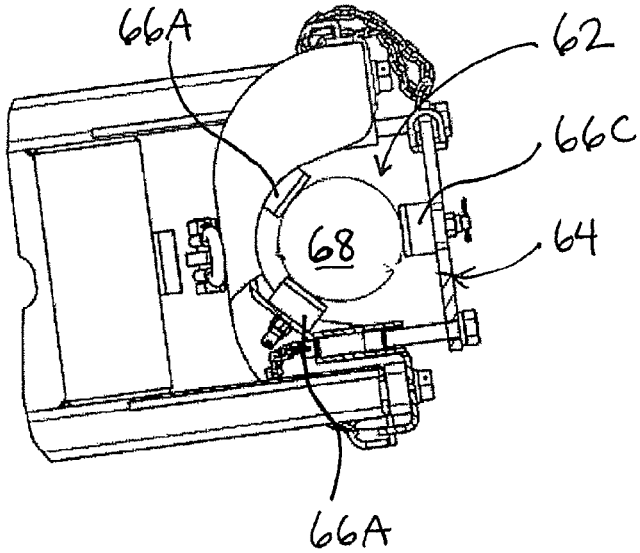
FIG. 8 is a partial cross-sectional view of a portion of a torque reaction device according to an embodiment of the invention.
Figure 6:
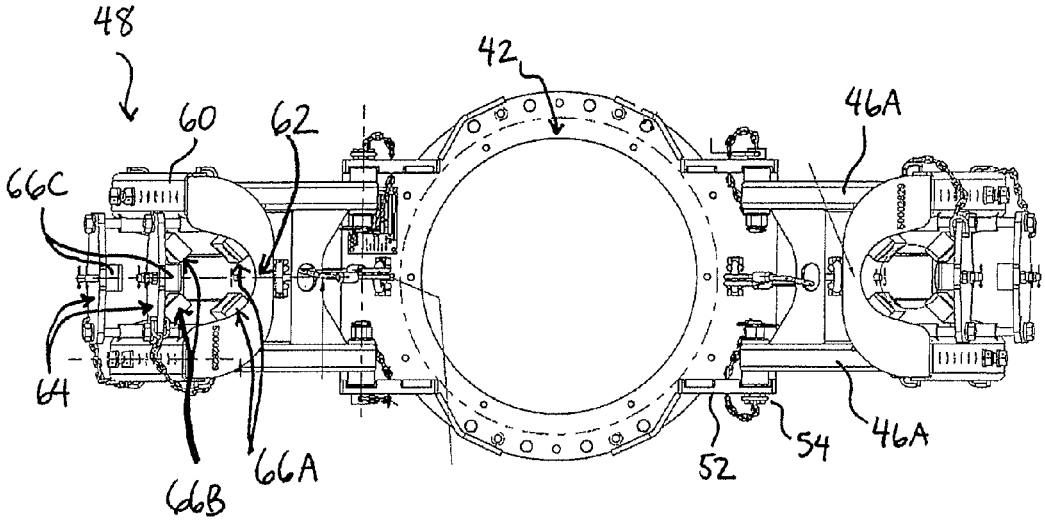
FIG. 6 is a top view of the torque reaction device of FIG. 5.
Figure 7:
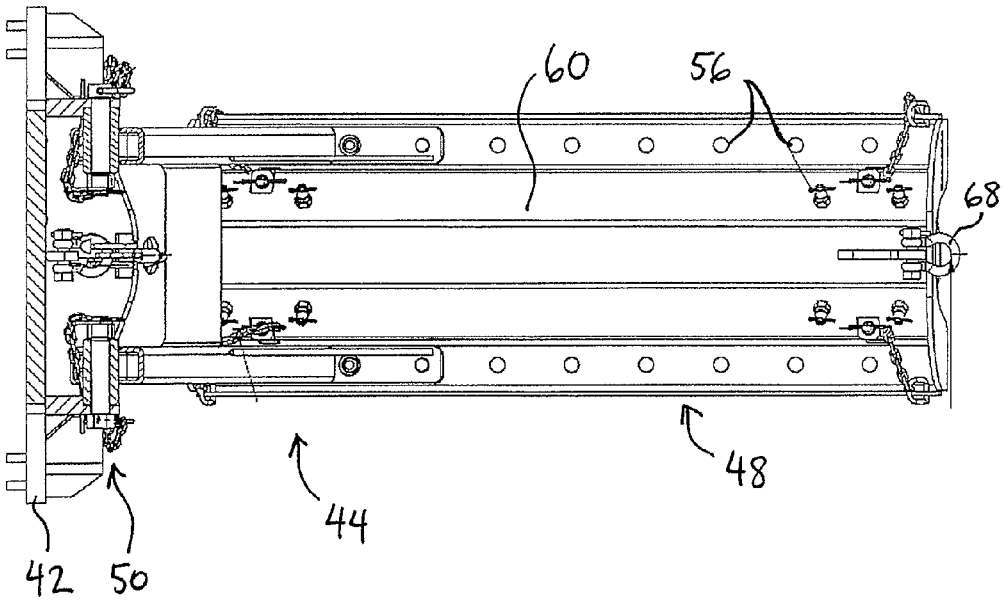
FIG. 7 is a side view of the torque reaction device of FIG. 5.

As shown in FIGS. 5 and 6, the reaction arm members 46A are each coupled to the base plate 42 by a hinge 50. Each hinge 50 includes a bracket or fitting 52 attached to or formed in the base plate 42 and a pin 54 that passes through aligned openings in the reaction arm members 46A and the fittings 52. The reaction arms 46 are rotatable about the pins 54, to allow rotation of the reaction arms 46 with respect to the base plate 42. This hinged rotation enables the reaction arm assemblies 44 to adjust to accommodate different link geometries, lengths, and configurations on different drilling rigs. For example, the reaction arm assemblies 44 can rotate about the hinge 50 depending on the angle $\alpha$ between the links 28 and the shaft 24 (see FIG. 3). This angle $\alpha$ may vary depending on the length of the shaft 24, the size of the elevator 26, the length of the links 28, and the presence and configuration of other components connected along the drive shaft. As an example, a may range from 5-10 degrees. In place of the hinge 50, other suitable connectors may be used to provide a rotatable coupling between the reaction arms 46 and the base plate 42.

At the opposite end of the reaction arm 46 from the hinge 50, the reaction arm is bolted to the corresponding clamp 48 at the rigid elbow joint 49. The clamps 48 are provided with a series of spaced bolt holes 56 which allow the position of the elbow joint 49 to be adjusted along the length of the clamps 48. This adjustable joint 49 enables the length of the clamp 48 extending above the joint 49 to be adjusted to accommodate links of varying lengths. In one embodiment, the adjustable length is about 20 inches. Instead of a series of spaced bolt holes 56, other adjustable mechanical fasteners can be provided between the clamps 48 and the arms 46. Additionally, in other embodiments, the location of the elbow joint 49 between the clamp 48 and the arm 46 is not adjustable. A brace 58 is optionally provided between the reaction arm members 46A and the clamps 48 for additional support.

The clamps 48 are designed to receive and firmly secure the top drive links 28, so that the torque reaction device 40 can urge against the links 28 without slipping. Each clamp 48 includes a receptacle or sleeve 60 forming a channel 62, and a pair of clamp plates 64. Each link 28 is received into the corresponding channel 62, and then the clamp plates 64 are attached to the sleeve 60 to trap the link 28 within the channel. The clamp plates 64 may be attached to the clamps by bolting the plates 64 to the sleeves 60. In one embodiment, each clamp 48 utilizes two clamp plates 64, one at either end of the sleeve 60. The sleeves 60 extend a length L along the links 28 to provide stability and to distribute the load along the links and provide sufficient torque reaction against the links 28 without buckling or slipping. The channels 62 brace the links within the clamps and provide a rigid connection for torque reaction. In one embodiment, the length L is about 40 inches.

In one embodiment, the clamps 48 are designed to accommodate multiple link sizes and geometries. Different drilling rigs may include top drive assemblies with links of differing cross-sectional shapes and/or diameters D (see FIG. 8). For example, link diameter may vary between about 3 inches to 6 inches. In order to firmly secure a variety of links 28 within the channels 62 of the clamps 48, the clamps may be provided with one or more wear pads or spacer blocks 66. In one embodiment, each clamp 48 includes six spacer blocks 66—two upper spacer blocks 66A and two lower spacer blocks 66B mounted to the sleeve 60 within the channel 62, and one spacer block 66C provided on each of the two clamp plates 64 (see FIGS. 6 and 8). These spacer blocks 66 can be provided in multiple sizes and shapes and can be removed and replaced from the clamp 48 depending on the size and shape of the links 28 of a particular drilling installation. For example, the spacer blocks 66 can be removably bolted to the sleeves 60. The spacer blocks 66 extend radially inwardly into the channel 62 to occupy any space between the channel 62 and the outer dimensions of the link 28. The link 28 is received into the channel 62 against the upper and lower spacer blocks 66A, 66B and the clamp plates 64 are then attached, trapping the link between the two sets of three cooperating spacer blocks 66A, 66B, and 66C. The link 28 is securely held in place within the channel, so that the reaction arm assemblies 44 can react against the links 28 without causing the links to twist or slip. In one embodiment, the spacer blocks are made from a durable polymer such as high-density polyethylene. The two upper spacer blocks 66A can be provided together as one unit that is bolted into place within the channel, so that this one unit can be removed as necessary or replaced with another unit of a different size. Similarly, the two lower spacer blocks 66B can be connected together as one unit.

Figure 9:
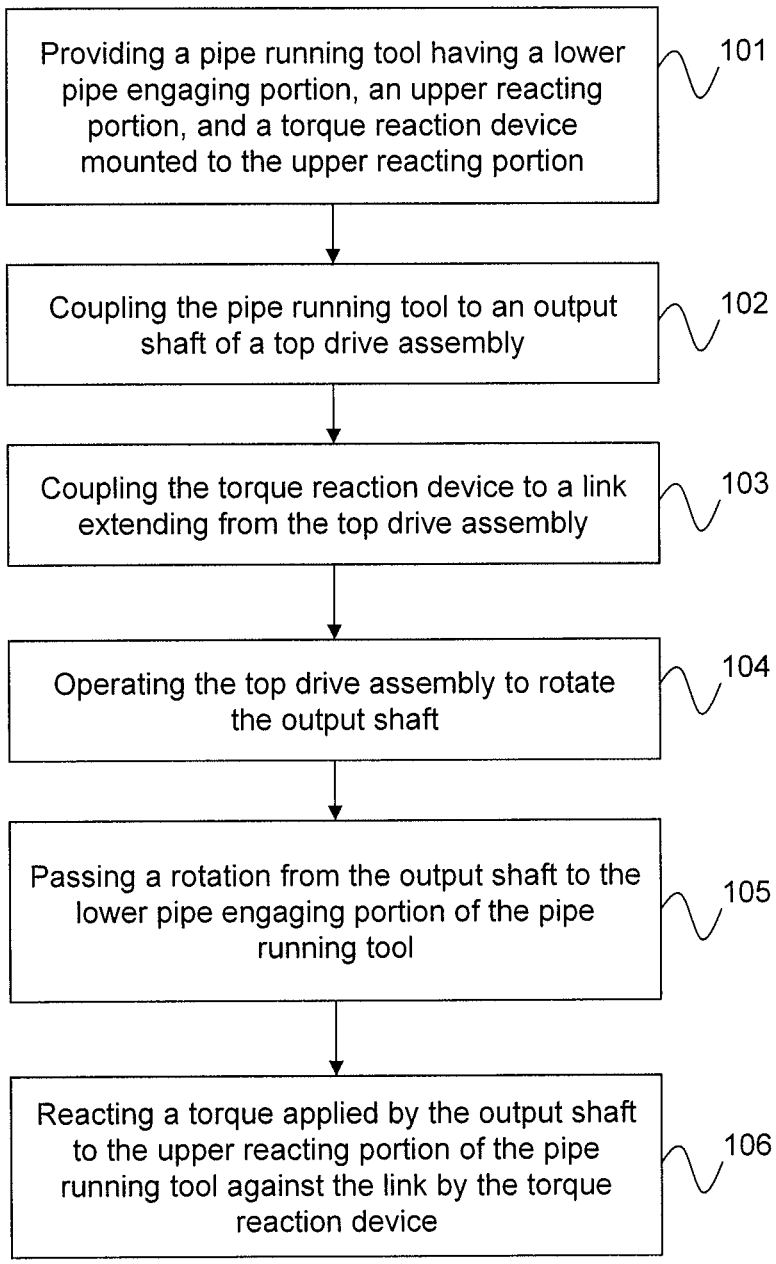
FIG. 9 is a flowchart of a method of reacting torque according to an embodiment of the invention.

In one embodiment, a method is provided for reacting torque applied to a pipe running tool, as shown for example in FIG. 9. In one embodiment, the method includes providing a pipe running tool, as shown in step 101 in FIG. 9. The pipe running tool has a lower pipe engaging portion, an upper reacting portion, and a torque reaction device mounted to the upper reacting portion. The method also includes coupling the pipe running tool to an output shaft of a top drive assembly 102, and coupling the torque reaction device to a link extending from the top drive assembly 103. The method then includes operating the top drive assembly to rotate the output shaft 104, and passing a rotation from the output shaft to the lower pipe engaging portion of the pipe running tool 105. This rotation passes through the upper reacting portion of the pipe running tool. The method also includes reacting a torque applied by the output shaft to the upper reacting portion of the pipe running tool against the link by the torque reaction device 106.

In one embodiment, the hinge 50 between the reaction arms 46 and the base plate 42 is used to couple the torque reaction device to the links. Referring to FIG. 3, the torque reaction device includes a shackle or loop 68 at the top end of each clamp 48, on the inner sides of the clamps. A rope or line is attached to the shackles 68 and pulled to lift the reaction arm assemblies 44 about the hinges 50. This action rotates the reaction arm assemblies 44 inwardly toward the shaft 24, away from the links 28. The links can then be moved into position over the clamps 48. The rope is then slowly released to rotate the reaction arm assemblies back outwardly toward the links, so that the links drop into the channels 62 of the clamps 48. Once the links 28 are fully received into the channels 62, the clamp plates 64 are attached, and then the rope can be disconnected and released.

In one embodiment, the method for reacting torque includes mounting the base plate 42 to the upper reacting portion 32 of the pipe running tool. In other embodiments, the base plate is pre-mounted to the upper reacting portion. Separately, the reaction arm assemblies 44 are prepared by bolting the clamps 48 to the reaction arms 46 at the appropriate holes 56 to form the elbow joints 49, depending on the desired length of the clamp. The appropriate spacer blocks are selected, if needed, and bolted to the sleeves 60. The pipe running tool 30 is positioned over the wellbore, and the reaction arm assemblies 44 are then attached to the pipe running tool by pinning the reaction arms 46 to the hinges 50. The top drive assembly is then lowered over the pipe running tool, and the links are guided into the clamps as described above. The pipe running tool is then coupled to the top drive assembly by threading the pipe running tool shaft 38 to the top drive output shaft 24. The various bolts along the clamps 48 should be tightened again prior to operation. Alternatively, the reaction arm assemblies 44 can be assembled and mounted to the pipe running tool after the pipe running tool is coupled to the top drive.

According to embodiments of the invention as described herein, a torque reaction device is provided to react against the links of the top drive assembly. This configuration is adjustable to accommodate links of various cross-section diameters, lengths, and angular orientations, so that the same pipe running tool and torque reaction device can be implemented on drilling rigs with various types of links. Additionally, the torque reaction system can be installed independently of the derrick or guide rail structure or setback distance, and does not rely on torque reaction structures that slide along the guide rails. This system effectively provides torque reaction while reducing the extent of customization needed for each individual drilling rig. The portion of the pipe running tool that connects to the service loop can be oriented as desired and held in this orientation during pipe running operations.

Although the present invention has been described and illustrated in respect to exemplary embodiments, it is to be understood that it is not to be so limited, since changes and modifications may be made therein which are within the full intended scope of this invention as hereinafter claimed.

What is claimed is:

1. A system for coupling a pipe segment to a pipe string, comprising:

a top drive assembly comprising
- a top drive;
- an output shaft; and
- a link extending from the top drive, the top drive being operative to rotate the output shaft with respect to the link;

a pipe running tool coupled to the output shaft, the pipe running tool being engageable with a pipe segment to transmit torque from the output shaft to the pipe segment; and a torque reaction device coupling the pipe running tool to the link, the torque reaction device comprising:
- a base plate coupled to the pipe running tool;
- a clamp coupled to the link; and
- a reaction arm coupled between the base plate and the clamp.

2. The system of claim 1, wherein the pipe running tool comprises a reacting portion and a pipe engaging portion, the pipe engaging portion being rotatable by the output shaft with respect to the reacting portion, and wherein the torque reaction device is mounted to the reacting portion.

3. The system of claim 2, wherein the pipe running tool further comprises an upper shaft connected to the top drive output shaft, and wherein the reacting portion comprises a housing through which the upper shaft passes.

4. The system of claim 2, wherein the reacting portion comprises a link tilt assembly.

5. The system of claim 2, wherein the reacting portion is coupled to a hydraulic, pneumatic, or electric service loop.

6. The system of claim 1, wherein the reaction arm is rotatably coupled to the base plate.

7. The system of claim 1, wherein the pipe running tool comprises an upper reacting portion and a lower pipe engaging portion, the lower pipe engaging portion being rotatable by the output shaft with respect to the upper reacting portion, and wherein the base plate is mounted to the upper reacting portion.

8. The system of claim 1, further comprising a plurality of spacer blocks mounted between the link and the clamp to secure the link within the clamp.

9. The system of claim 1, further comprising a plate secured to the clamp to trap the link within the clamp.

10. The system of claim 1, wherein the torque reaction device is adjustable to accommodate a varying angle between the link and the output shaft.

11. The system of claim 1, wherein the link comprises first and second links extending from opposite sides of the top drive assembly toward the pipe running tool, and wherein the torque reaction device couples the pipe running tool to the first and second links.

12. The system of claim 1, wherein the pipe running tool comprises an upper reacting portion positioned above a lower pipe engaging portion, the lower pipe engaging portion being rotatable by the output shaft with respect to the upper reacting portion, and wherein the torque reaction device is mounted to the upper reacting portion.

13. The system of claim 1, wherein the base plate is integral with the pipe running tool.

14. The system of claim 1, wherein the clamp is coupled to the reaction arm by a connector that is adjustable along a length of the clamp.

15. A pipe running tool for use with a top drive assembly, for handling pipe segments and for engaging pipe segments to a pipe string, comprising:

an upper reacting portion;

a lower pipe engaging portion engageable with a pipe segment and rotatable with respect to the upper reacting portion, for transmitting torque to the pipe segment; and a torque reaction device mounted to the upper reacting portion and securable to a portion of the top drive assembly, for transmission of torque from the upper reacting portion to the top drive assembly, the torque reaction device comprising a base plate coupled to the upper reacting portion, a clamp engageable with a non-rotating portion of the top drive assembly, and a reaction arm coupled between the base plate and the clamp.

16. The pipe running tool of claim 15, wherein the clamp of the torque reaction device is securable to a link extending from the top drive assembly, and the reaction arm is rotatably coupled to the base plate by a hinge.

17. The pipe running tool of claim 15, wherein the clamp is coupled to the reaction arm by a connector that is adjustable along a length of the clamp.

18. The pipe running tool of claim 15, wherein the base plate is integral with the upper reacting portion.

19. A method for reacting torque applied to a pipe running tool in a drill rig having a top drive assembly, the method comprising:

providing a pipe running tool having a lower pipe engaging portion, an upper reacting portion, and a torque reaction device mounted to the upper reacting portion, the torque reaction device comprising a base plate coupled to the pipe running tool, a clamp engageable to a link extending from the top drive assembly, and a reaction arm coupled between the base plate and the clamp;

coupling the pipe running tool to an output shaft of the top drive assembly; and coupling the clamp of the torque reaction device to the link extending from the top drive assembly.

20. The method of claim 19, further comprising:

operating the top drive assembly to rotate the output shaft;

passing a rotation from the output shaft to the lower pipe engaging portion of the pipe running tool; and reacting a torque applied by the output shaft to the upper reacting portion of the pipe running tool, wherein reacting comprises reacting the torque against the link by the torque reaction device.

21. The method of claim 20, wherein coupling the clamp of the torque reaction device to the link comprises rotating the clamp about a hinge.

* * * * *